United States Patent [19]

Tsujimura et al.

[11] 4,441,856

[45] Apr. 10, 1984

[54] STEAM TURBINE FOR GEOTHERMAL POWER GENERATION

[75] Inventors: Kazunari Tsujimura, Tokyo; Yoshikazu Hadano, Yokohama, both of Japan

[73] Assignee: Tokyo Shibaura Denki Kabushiki Kaisha, Kawasaki, Japan

[21] Appl. No.: 313,615

[22] Filed: Oct. 21, 1981

[30] Foreign Application Priority Data

Oct. 22, 1980 [JP] Japan ..... 55-149743[U]

[51] Int. Cl.[3] ..... F01D 17/18; F01D 9/04

[52] U.S. Cl. ..... 415/155; 415/184

[58] Field of Search ..... 415/183, 184, 185, 219 R, 415/155, 216, 218; 60/641.5

[56] References Cited

U.S. PATENT DOCUMENTS 2,187,788 1/1940 Kraft ..... 415/185

3,176,958 4/1965 Ryall ..... 415/218

*Primary Examiner*—Stephen Marcus

*Assistant Examiner*—Joseph M. Pitko

*Attorney, Agent, or Firm*—Oblon, Fisher, Spivak, McClelland & Maier

[57] ABSTRACT

A steam turbine comprises a casing; turbine vanes rotatably set in the casing; a plurality of partition walls which extend along radial directions from the rotation center of the turbine vanes to define a plurality of steam valve chambers in the casing; steam supply pipes respectively connected to the corresponding steam valve chambers; and regulating valves which are fitted to the respective steam supply pipes to regulate respectively the flow rate of steam streams supplied to the respective steam valve chambers. At least one partition wall for dividing the interior space of the steam turbine into adjacent steam valve chambers is provided with at least one penetrating hole for causing the steam valve chambers to communicate with each other.

4 Claims, 2 Drawing Figures

STEAM TURBINE FOR GEOTHERMAL POWER GENERATION

BACKGROUND OF THE INVENTION

This invention relates to a steam turbine used for geothermal power generation and provided with a plurality of steam valve chambers. More particularly, this invention relates to such a steam turbine capable of carrying out a partial load drive.

A steam turbine's output is generally controlled by either the so-called speed-throttling process, which comprises controlling the simultaneous operation of a plurality of regulating valves attached to one steam valve chamber, or the so-called nozzle speed regulating process, which comprises gradually controlling the operation of a plurality of regulating valves one after another. The former process, which causes all the regulating valves to be opened or closed at the same time, minimizes the flow loss of steam, and it is consequently favorably accepted in the full load operation of a steam turbine. In contrast, the latter process, which causes the regulating valves to be opened or closed one after another, assures the effective application of steam energy, and it is consequently well adapted for the partial load drive of a turbine.

Recently from the standpoint of saving energy, geothermal turbines have come to be applied in an increasing number. Since it is demanded to save geothermal water or hot springs as much as possible, the aforementioned speed-throttling process fails to be favorably accepted. Where, therefore, the geothermal water is utilized, the nozzle speed-regulating process is also demanded to be so improved as to attain a desired result. The reason is that, where the nozzle speed-regulating process is adopted for a turbine driven by the geothermal water, solid particles contained in the geothermal water such as those of compounds of, for example, arsenic, hydrogen and sulfur tend to be accumulated in those of the steam valve chambers which are not put into operation at the time of a partial load drive of the turbine; and if this objectable condition should be allowed to stand, then steam streams will flow less smoothly, leading to an increased loss of the steam pressure and the erosion and corrosion of the steam vlave chambers by the above-mentioned solid particles of impurities entrained with the geothermal water.

SUMMARY OF THE INVENTION

This invention has been accomplished to eliminate the difficulties encountered with various types of conventional turbines intended to be driven by steam. To attain the above-mentioned object, this invention provides a steam turbine wherein partition walls for dividing the interior space of the turbine are each provided with one or more holes to let the adjacent steam chambers defined by the partition walls communicate with each other, thereby resolving the aforementioned drawbacks accompanying the conventional steam turbine.

DETAILED DESCRIPTION OF THE PREFERRED EMBODIMENT

Description is now given with reference to the accompanying drawing of a steam turbine according to one embodiment of this invention.

Figure 2:
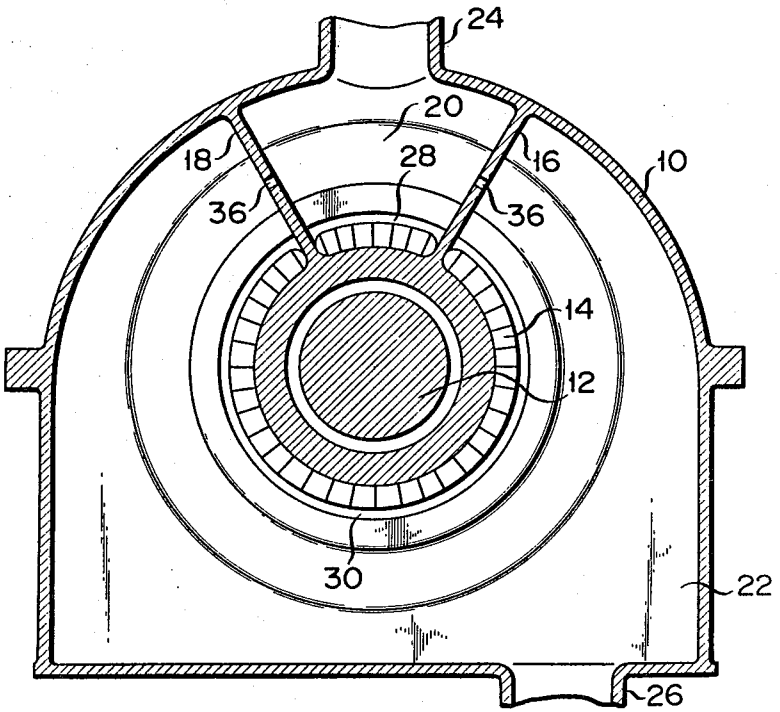
FIG. 2 is across sectional view of the same on line II—II of FIG. 1.
Figure 1:
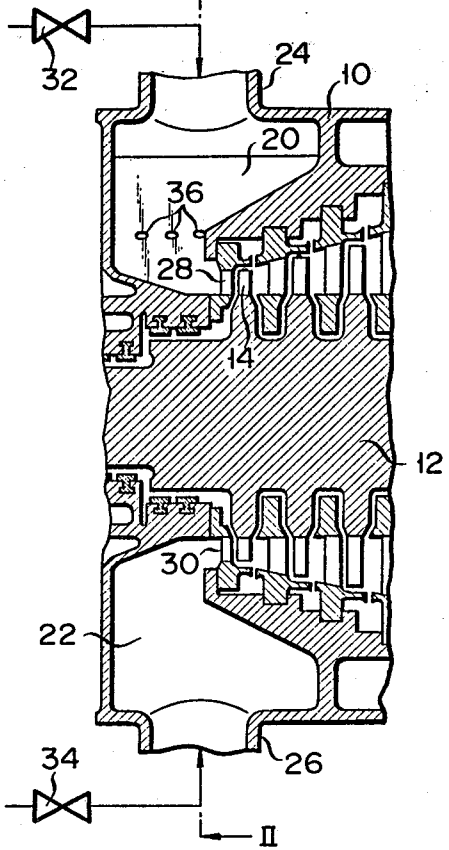
FIG. 1 is a fractional longitudinal sectional view of a steam turbine according to one embodiment of this invention.

Referring to FIG. 1, the steam turbine comprises a casing 10. A rotary shaft 12 is rotatably fitted to the casing 10. The rotary shaft 12 is fitted with a large number of vanes 14. With this embodiment, a plurality of (two) partition walls 16, 18 are provided in a state along radial directions extending from the center of the rotary shaft 12, thereby defining two steam valve chambers 20, 22. These steam valve chambers 20, 22 respectively communicate at one end with the corresponding steam supply pipes 24, 26 and at the other end with the corresponding ejection ports or nozzles 28, 30 facing the vanes 14. The steam supply pipes 24, 26 are respectively connected to the corresponding regulating valves 32, 34 (FIG. 1), which in turn are connected to a common turbine rotation speed-controlling section (not shown).

The partition walls 16, 18 respectively comprise a plurality of small holes 36 formed at the prescribed position. These small holes 36 allow the adjacent steam valve chambers 20, 22 to communicate with each other.

Description is now given of the operation of a steam turbine embodying this invention.

Now let it be assumed that the steam turbine is driven with a partial load. In this case, one regulating valve 32 of one steam valve chamber 20 is throttled by the speed control section (not shown). As a result, the flow rate of steam streams in the corresponding steam supply pipe 24 decreases, causing the run of steam streams in one steam valve chamber 20 to slow down. Consequently, the aforementioned solid particles entrained with geothermal steam begin to settle in the proximity of the upstream section of the nozzle 28. On the other hand, the other regulating valve 34 is left open, and high pressure steam streams pass through the corresponding steam valve chamber 22 and are ejected through the nozzle 30, thereby causing the turbine vanes 14 to rotate about the rotary shaft 12. As a result, a difference occurs in the steam pressure of one steam valve chamber 20 and that of the other steam valve chamber 22. Therefore, steam streams eject through the small holes 36 of the partition walls 16, 18 from the high pressure steam valve chamber 22 to the low pressure steam valve chamber 20. The ejected steam streams cause the previously described solid particles which tend to settle in the proximity of the upstream section of the nozzle 28 of the low pressure steam valve chamber 20 to be scattered from the proximity inward of the steam turbine, thereby preventing the solid particles from being deposited in the proximity of the upstream section of the nozzle 28 of the low pressure steam valve chamber 20. Where, therefore, the steam turbine is driven with a full load, it is possible to let the steam turbine produce a full output with the regulating valve 32 left open.

The foregoing embodiment refers to the case where the steam supply pipes, regulating valves, steam chambers and partition walls were respectively provided in a number of 2. Obviously, these members may be provided in a larger number than 2.

As described above, the provision of partition walls for dividing the interior space of the turbine into a plurality of steam valve chambers, and the formation of a large number of small holes in the partition walls cooperate to prevent the aforesaid solid particles entrained with steam streams from being deposited in the proximity of the upstream section of the nonoperating nozzle. Therefore, it is possible to widely accept the nozzle speed control process for a steam turbine driven by geothermal steam and prominently elevate the partial load operation of the geothermal turbine. The present invention is applicable to not only the geothermal turbine, but also the general steam turbine with the same effect.

What we claim is:

1. In a steam turbine for geothermal power generation utilizing the steam of geothermal water, said steam turbine comprising:

(a) a casing;

(b) turbine vanes rotatably set in the casing;

(c) a plurality of partition walls which extend along radial directions from the rotation center of the turbine vanes to define a plurality of steam valve chambers in the casing;

(d) steam supply pipes respectively connected to the corresponding steam valve chambers; and (e) regulating valves which are fitted to the respective steam supply pipes to regulate respectively the flow rate of steam streams supplied to the respective steam valve chambers, the improvement in which:

(f) at least one of said partition walls for dividing the interior space of the steam turbine into adjacent steam valve chambers is provided with at least one circumferentially extending penetrating hole for causing adjacent steam valve chambers on either side of said at least one of said partition walls to communicate with each other.

2. In a steam turbine as recited in claim 1, the further improvement wherein each of said partition walls for dividing the interior space of the steam turbine into adjacent steam valve chambers is provided with at least one circumferentially extending penetrating hole for causing said steam valve chambers to communicate with each other.

3. A steam turbine for geothermal power generation utilizing the steam of geothermal water, said steam turbine comprising:

(a) a casing;

(b) turbine vanes rotatably set within the casing;

(c) a plurality of partition walls which extend in radial directions from the rotational center of the turbine vanes to define a plurality of steam valve chambers within the casing, at least one of said partition walls being provided with at least one circumferentially extending penetrating hole for causing adjacent steam valve chambers on either side of said at least one of said partition walls to be brought into communication with each other;

(d) steam supply pipes respectively connected to the corresponding steam valve chambers; and (e) regulating valves which are fitted to the respective steam supply pipes to regulate respectively the flow rate of steam jets of the geothermal water supplied to respective steam valve chambers, whereby the steam of the geothermal water existing in one of the steam valve chambers flows through the penetrating hole into an adjacent chamber, thereby preventing solid particles entrained in the geothermal water from clogging the steam turbine.

4. A steam turbine as recited in claim 3 wherein each of said partition walls is provided with at least one circumferentially extending penetrating hole for causing said steam valve chambers to communicate with each other.

* * * * *